US008060980B2

(12) United States Patent
Mayes et al.

(10) Patent No.: US 8,060,980 B2
(45) Date of Patent: Nov. 22, 2011

(54) FLOOR CARE APPLIANCE EQUIPPED WITH BREAK-OVER PROTECTED LATCH ASSEMBLY

(75) Inventors: R. Michael Mayes, Lancaster, KY (US); Kerry L. Dever, Lexington, KY (US)

(73) Assignee: Panasonic Corporation of North America, Secaucus, NJ (US)

( * ) Notice: Subject to any disclaimer, the term of this patent is extended or adjusted under 35 U.S.C. 154(b) by 713 days.

(21) Appl. No.: 12/057,965

(22) Filed: Mar. 28, 2008

(65) Prior Publication Data

US 2009/0241284 A1 Oct. 1, 2009

(51) Int. Cl.
*A47L 9/00* (2006.01)

(52) U.S. Cl. ..... 15/410; 15/327.1

(58) Field of Classification Search ..... 15/410, 15/347, 349, 352, 327.1, 327.5, 353, 354, 15/411, 328
See application file for complete search history.

(56) References Cited

U.S. PATENT DOCUMENTS

| | | | | |
|---|---|---|---|---|
| 2,823,411 | A | 2/1958 | Kirby | |
| 3,512,207 | A | 5/1970 | Ettridge | |
| 3,683,449 | A | 8/1972 | Nordeen | |
| 4,423,534 | A | 1/1984 | Lyman et al. | |
| 4,662,026 | A * | 5/1987 | Sumerau et al. | 15/329 |
| 4,670,937 | A * | 6/1987 | Sumerau et al. | 15/329 |
| 4,700,429 | A | 10/1987 | Martin et al. | |
| 6,006,401 | A | 12/1999 | Jailor et al. | |
| 6,012,200 | A | 1/2000 | Murphy et al. | |
| 7,124,467 | B2 * | 10/2006 | Hitzelberger et al. | 15/416 |
| 7,360,275 | B2 * | 4/2008 | Allgeier et al. | 15/347 |
| 2004/0216265 | A1 * | 11/2004 | Peacock et al. | 15/384 |
| 2005/0060835 | A1 * | 3/2005 | Kondo | 15/347 |

* cited by examiner

*Primary Examiner* — Dung Van Nguyen

(74) *Attorney, Agent, or Firm* — King & Schickli, PLLC

(57) ABSTRACT

A floor care appliance includes a housing having a nozzle assembly with a suction inlet. A dirt collection vessel and a suction generator are carried on the housing. A control handle pivotally connects to the nozzle assembly and is selectively displaceable between a storage position and an operating position. A latch assembly is displaceable between a locking position to secure the control handle in the storage position and a release position to allow full movement of the control handle into the operating position. The latch assembly is characterized by a latch stop and a latch carried on the nozzle assembly. The latch has two mounting points with one of the mounting points being displaceable between a home position and a control handle break-over release position.

25 Claims, 8 Drawing Sheets

FLOOR CARE APPLIANCE EQUIPPED WITH BREAK-OVER PROTECTED LATCH ASSEMBLY

TECHNICAL FIELD AND INDUSTRIAL APPLICABILITY OF THE INVENTION

The present invention relates generally to the floor care equipment and, more particularly, to a floor care appliance incorporating a unique latch assembly for locking and releasing the control handle in and from an upright storage position.

BACKGROUND OF THE INVENTION

Canister vacuum cleaners have long been known in the art to be useful for cleaning dirt and debris from bare floors, rugs, carpets and other above floor surfaces. Such vacuum cleaners typically include a canister assembly housing a dirt collection vessel and suction generator. In addition, such vacuum cleaners include a nozzle assembly, often equipped with a power driven rotary agitator and a wand and hose assembly for connecting the nozzle assembly and canister assembly. In one possible embodiment the wand is releaseably secured to the nozzle assembly and serves the additional function of a control handle for manipulating the nozzle assembly to and fro across the floor during the cleaning operation.

Typically the wand/control handle may be locked into an upright storage position. The present invention relates to a new and improved latch assembly for the wand/control handle. The latch assembly is displaceable between a locking position to secure the control handle in the storage position and a release position to allow full movement of the control handle into the operating position. The improvement comprises a structure allowing the latch to move to a control handle break-over release position which prevents damage to the latch assembly in the event the operator inadvertently forces the control handle into the operating position from the storage position without first releasing the latch assembly.

SUMMARY OF THE INVENTION

In accordance with the purposes of the present invention as described herein, an improved floor care appliance is provided. The floor care appliance comprises a housing including a nozzle assembly having a suction inlet, a dirt collection vessel and a suction generator. The dirt collection vessel and suction generator are both carried on the housing. In addition, the floor care appliance comprises a control handle pivotally connected to the nozzle assembly and selectively displaceable between a storage position and an operating position. Further, a latch assembly is displaceable between a locking position to secure the control handle in the storage position and a release position to allow full movement of the control handle into the operating position.

More specifically, the latch assembly is characterized by a latch stop and a latch carried on the nozzle assembly. The latch includes a first end and a second end. In addition, the latch assembly includes a first mounting point on the nozzle assembly that receives and holds the first end of the latch and a second mounting point on the nozzle assembly that receives and holds the second end of the latch. The second mounting point is displaceable between a home position and a control handle break-over release position.

In accordance with additional aspects of the present invention, the floor care appliance further includes a first biasing element to bias the latch into the locking position. In addition, a second biasing element is provided to bias the second mounting point into the home position. In one possible embodiment the first biasing element comprises a torsion spring while the second biasing element comprises a compression spring.

More specifically describing the invention, the first mounting point is an aperture in the nozzle assembly that receives and engages the first end of the latch while allowing free rotational movement and limited pivotal movement of the latch relative to the nozzle assembly. The second mounting point is a trunnion. That trunnion is captured in a channel provided in the nozzle assembly. The compression spring, referred to above, extends between the bottom wall of the channel and the trunnion. The trunnion includes a slot receiving the second end of the latch and a guide received in a guide way formed by the channel.

In accordance with still additional aspects of the present invention, the latch includes an n-shaped section between the first end and the second end. In addition, a foot pedal actuator is connected to the latch. Further the housing includes a canister assembly. In addition the control handle comprises a wand. A flexible suction hose connects the wand to the canister assembly whereby a suction pathway is provided from the suction inlet of the nozzle assembly to the suction generator on the canister assembly through the wand, flexible suction hose and dirt collection vessel.

Alternatively, the present invention may be described as a floor care appliance comprising a housing including a nozzle assembly having a suction inlet, a dirt collection vessel and a suction generator. The dirt collection vessel and suction generator are both carried on the housing. In addition the appliance comprises a control handle pivotally connected to the nozzle assembly and selectively displaceable between a storage position and an operating position. Further, the appliance includes a latch assembly displaceable between a locking position to secure the control handle in a storage position and a release position to allow movement of the control handle into the operating position.

The latch assembly may be further characterized by a latch stop carried on the control handle and a latch carried on the nozzle assembly. That latch includes an axis of rotation. That axis of rotation is displaceable between a first, home position and a second, control handle break-over release position.

In the following description there is shown and described one possible embodiment of this invention, simply by way of illustration of one of the modes best suited to carry out the invention. As it will be realized, the invention is capable of other different embodiments and its several details are capable of modification in various, obvious aspects all without departing from the invention. Accordingly, the drawings and descriptions will be regarded as illustrative in nature and not as restrictive.

BRIEF DESCRIPTION OF THE DRAWINGS

The accompanying drawings incorporated herein and forming a part of the specification, illustrate several aspects of the present invention and together with the description serve to explain certain principles of the invention. In the drawings.

Reference is now made in detail to the present invention, an example of which is illustrated in the accompanying drawings.

DETAILED DESCRIPTION OF THE PREFERRED EMBODIMENTS OF THE INVENTION

Figure 1:
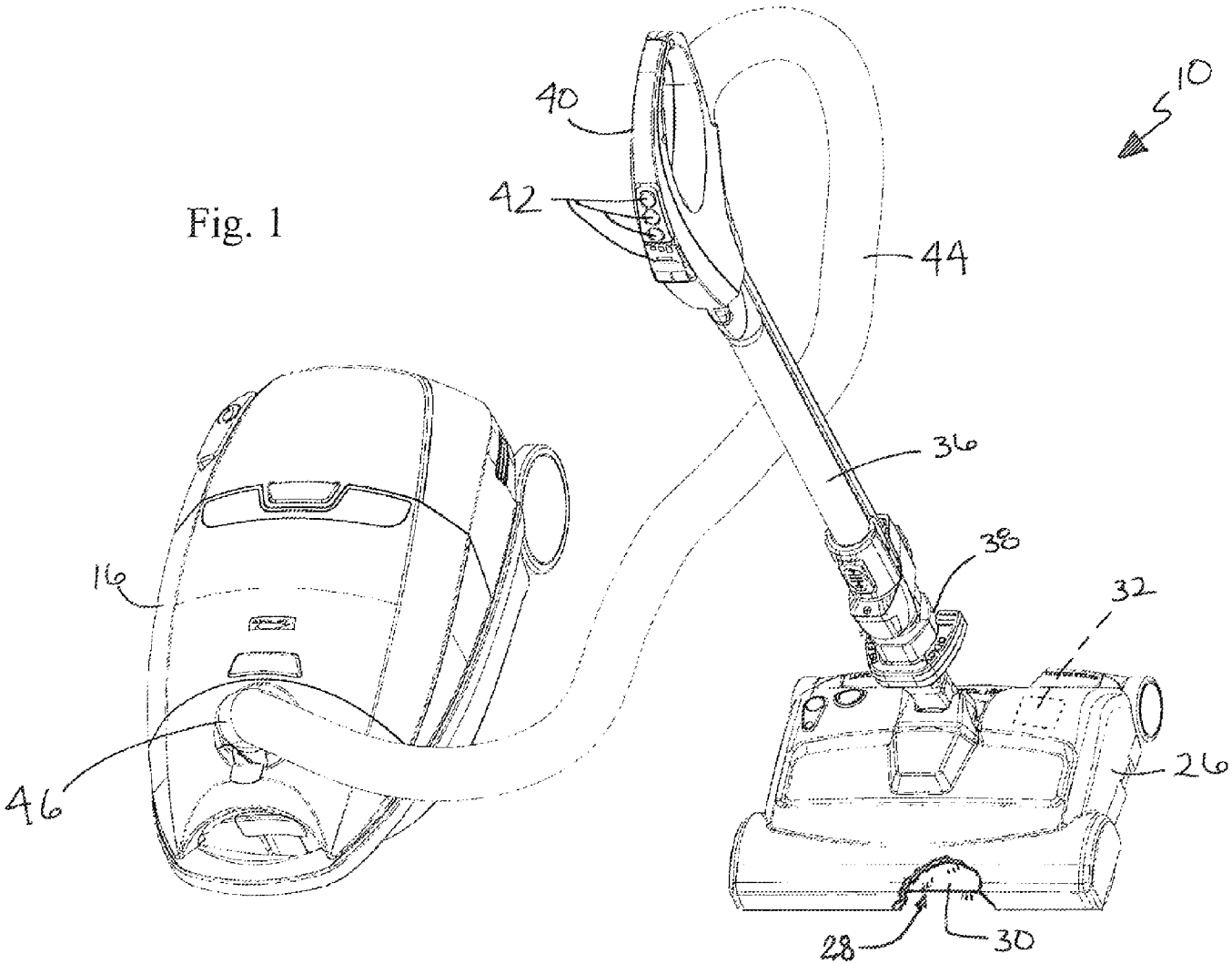
FIG. 1 is a perspective view of the floor care appliance of the present invention.
Figure 2:
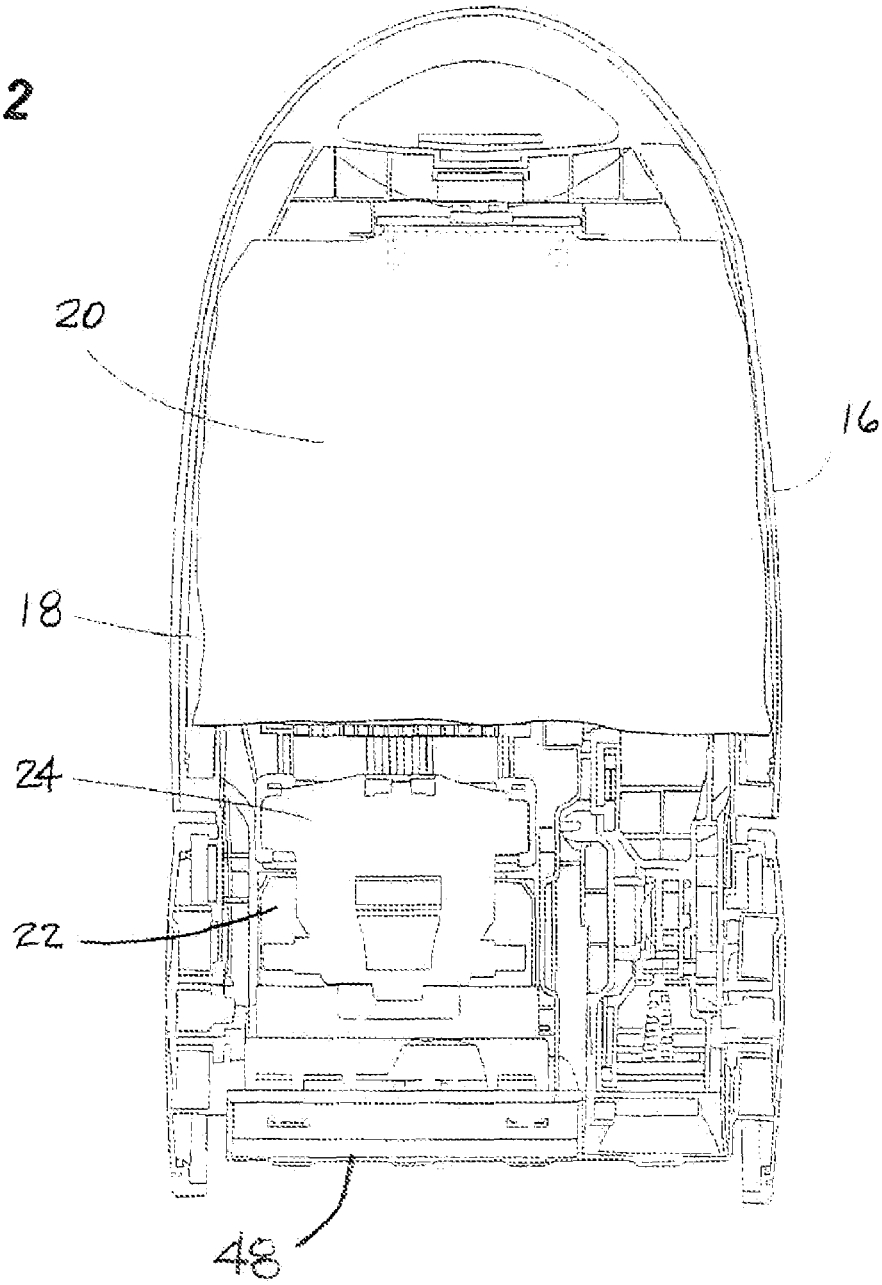
FIG. 2 is a top plan view, with cover removed, illustrating the internal structure of the canister assembly illustrated in FIG. 1.

Reference is now made to FIGS. 1 and 2 illustrating a floor care appliance 10 of the present invention. In the illustrated embodiment, the floor care appliance 10 takes the form of a canister vacuum cleaner. The canister vacuum cleaner 10 includes a canister housing 16 having a receiver or cavity 18 for receiving a dirt collection vessel 20 used to collect dirt and debris in a manner known in the art. As illustrated in FIG. 2, the dirt collection vessel 20 is a filter bag made from a filter media material of the type known in the art. Alternatively, the dirt collection vessel 20 could take the form of a dirt cup (not shown). Such a dirt cup may include a cylindrical sidewall, a tangentially directed inlet and an axially directed outlet. Further, a main, or primary, filter may be provided in the dirt cup over the outlet. The filter may be cylindrically shaped and concentrically received within the side wall of the dirt cup so as to provide an annular space there-between. The tangentially directed inlet promotes cyclonic airflow within this annular space to enhance the cleaning efficiency of the canister vacuum cleaner 10 equipped in this manner.

Referring back to drawing FIG. 2, the canister housing 16 also includes a compartment 22 that receives a suction generator 24. The canister vacuum cleaner 10 further includes a nozzle assembly 26. In the illustrated embodiment, the nozzle assembly 26 includes a suction inlet 28, a rotary agitator 30 extending across the suction inlet 28, and an agitator drive motor 32. The drive motor 32 may be connected to the rotary agitator 30 by means of a drive belt (not shown). It should be appreciated, however, that alternative drive systems such as an all gear drive could be utilized.

A control handle, generally designated by reference numeral 36, includes a first end releasably received in a coupler 38 pivotally connected to the nozzle assembly 26 and a second end incorporating a hand grip 40. As illustrated, the hand grip 40 includes a series of switches 42 for controlling the operation of the vacuum cleaner 10. The control handle 36 is tubular in form and includes an internal lumen to thereby allow the control handle 36 to function as a wand. The control handle/wand 36 is connected to a first end of a flexible suction hose 44 that connects the control handle/wand to the hose coupler 46 on the canister assembly 16. Consequently, a suction pathway is provided from the suction inlet 28 of the nozzle assembly 26 to the suction generator 24 on the canister assembly 16 through the control handle/wand 36, the flexible suction hose 44 and the dirt collection vessel 20.

During operation, the rotary agitator 30 beats dirt and debris from an underlying rug or carpet. That dirt and debris is entrained into the suction air stream being drawn into the suction inlet 28 by operation of the suction generator 24. Dirt and debris entrained in the air stream is then drawn through the control handle/wand 36 and hose 44 into the dirt collection vessel 20. Dirt and debris is trapped in the dirt collection vessel 20 and the now clean air is then drawn through the motor of the suction generator 24 in order to provide cooling. That air is then forced through a final filter 48, such as a HEPA® filter, to provide final cleaning before being exhausted back into the environment.

Figure 3:
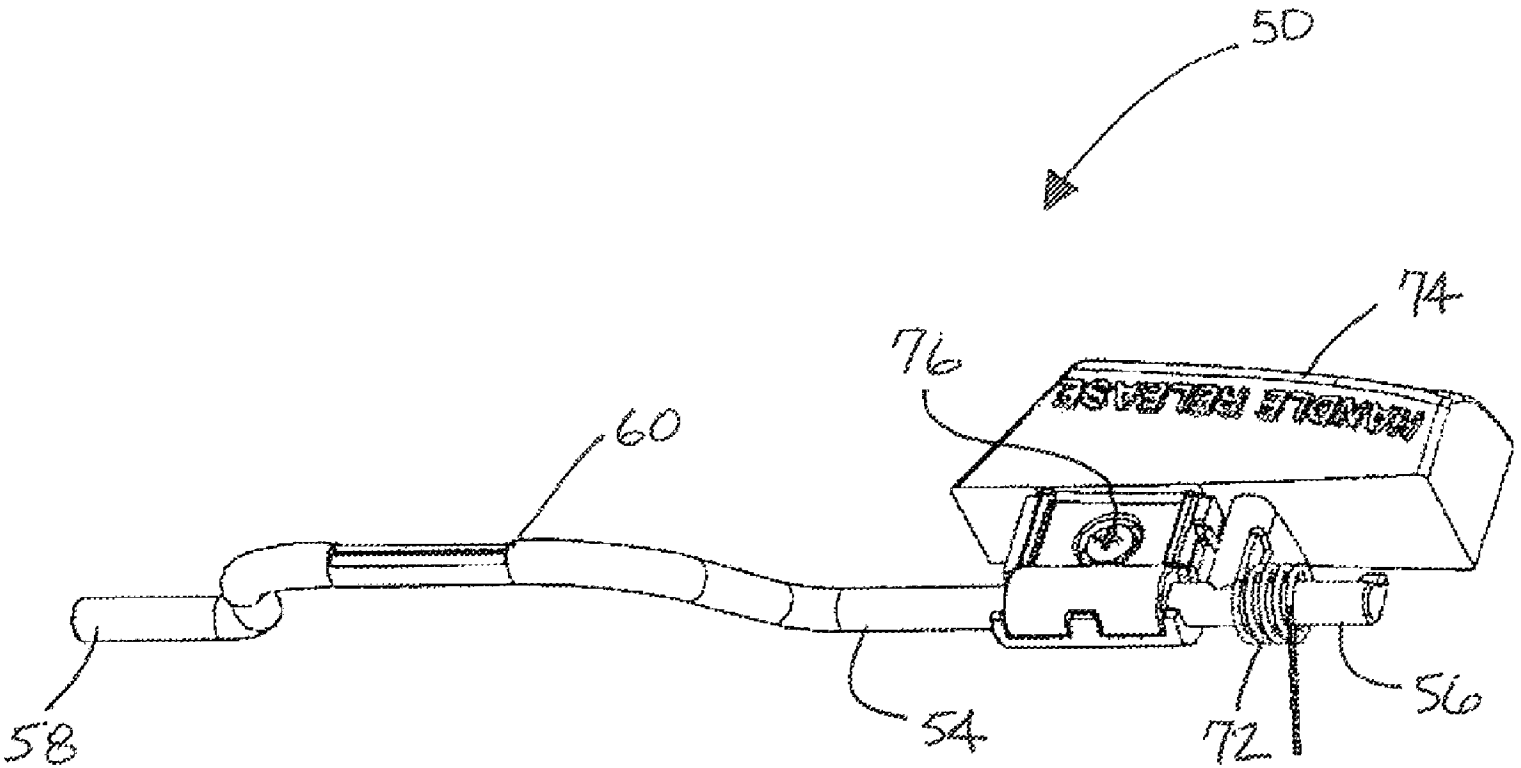
FIG. 3 is a perspective view of the latch, foot pedal actuator and first biasing element.
Figure 4:
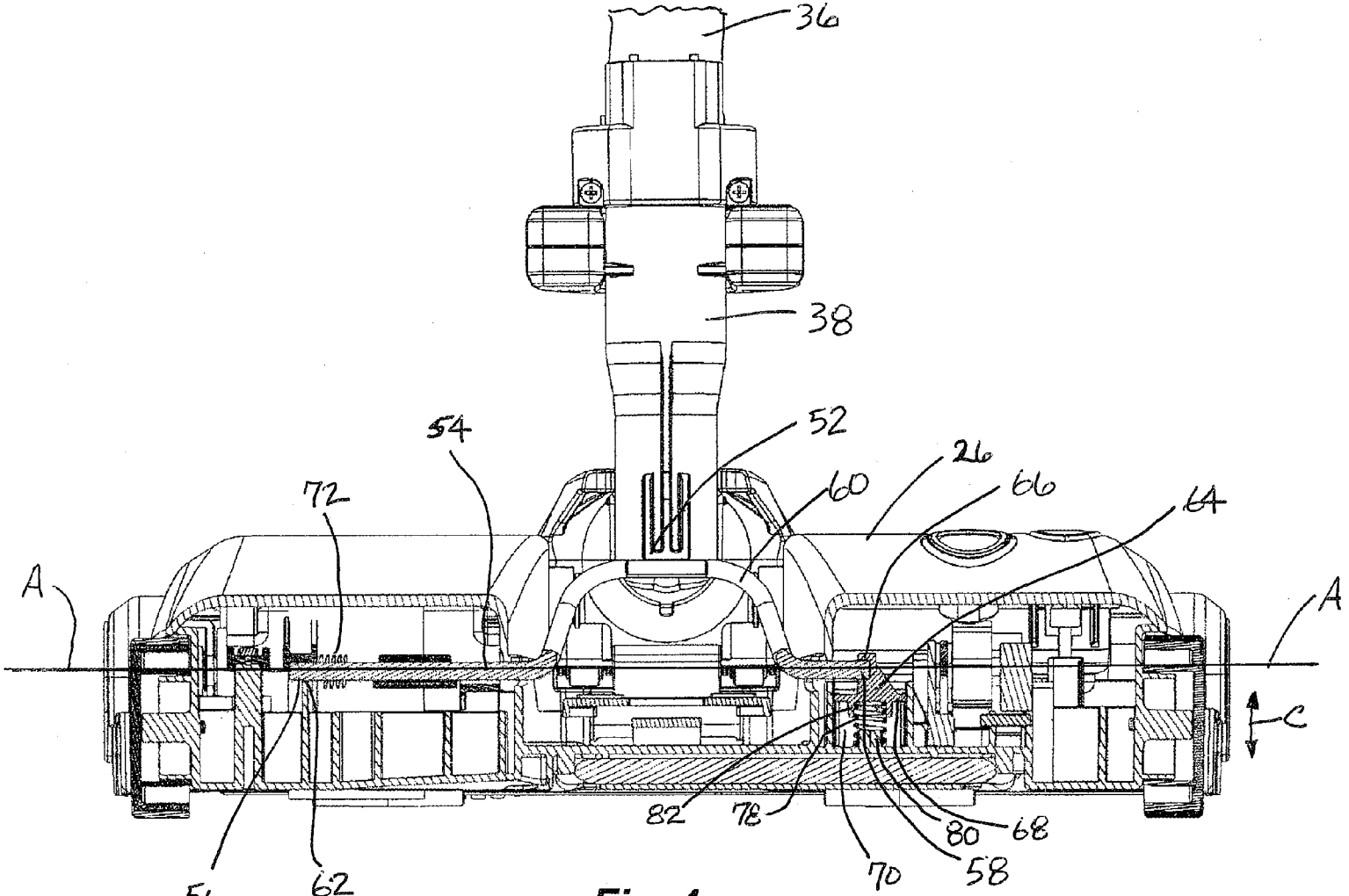
FIG. 4 is a detailed partly cross-sectional view illustrating the latch assembly on the nozzle assembly in the home position.

Normally, the control handle 36 is held in an upright storage position (see, for example, FIGS. 1 and 3). A latch assembly, generally designated by reference numeral 50 functions to lock the control handle 36 in this storage position. As best illustrated in FIGS. 3 and 4, the latch assembly 50 comprises a latch stop 52 carried on the control handle coupler 38 and a cooperating latch 54 carried on the nozzle assembly 26. As illustrated, the latch 54 may take the form of a metal rod having a first end 56, a second end 58 and an intermediate n-shaped section 60.

A first mounting point in the form of an aperture 62 is provided in a wall of the nozzle assembly 26. The aperture 62 receives and engages the first end 56 of the latch 54 while allowing free rotational movement and limited pivotal movement of the latch relative to the nozzle assembly 26.

A second mounting point, in the form of a displaceable trunnion 64 is also provided on the nozzle assembly 26. The trunnion 64 includes a slot 66 for receiving the second end 58 of the latch 54 and a guide 68 received in a guide way formed by a channel 70 formed in the nozzle assembly 26.

A first biasing element 72 biases the latch 54 of the latch assembly 50 into the locking position. As best illustrated in FIGS. 3 and 4, the first biasing element 72 may take the form of a torsion spring. A foot pedal actuator 74 is secured to the first end 56 of the latch 54 adjacent the torsion spring 72 by means of a fastener 76.

Figure 5:
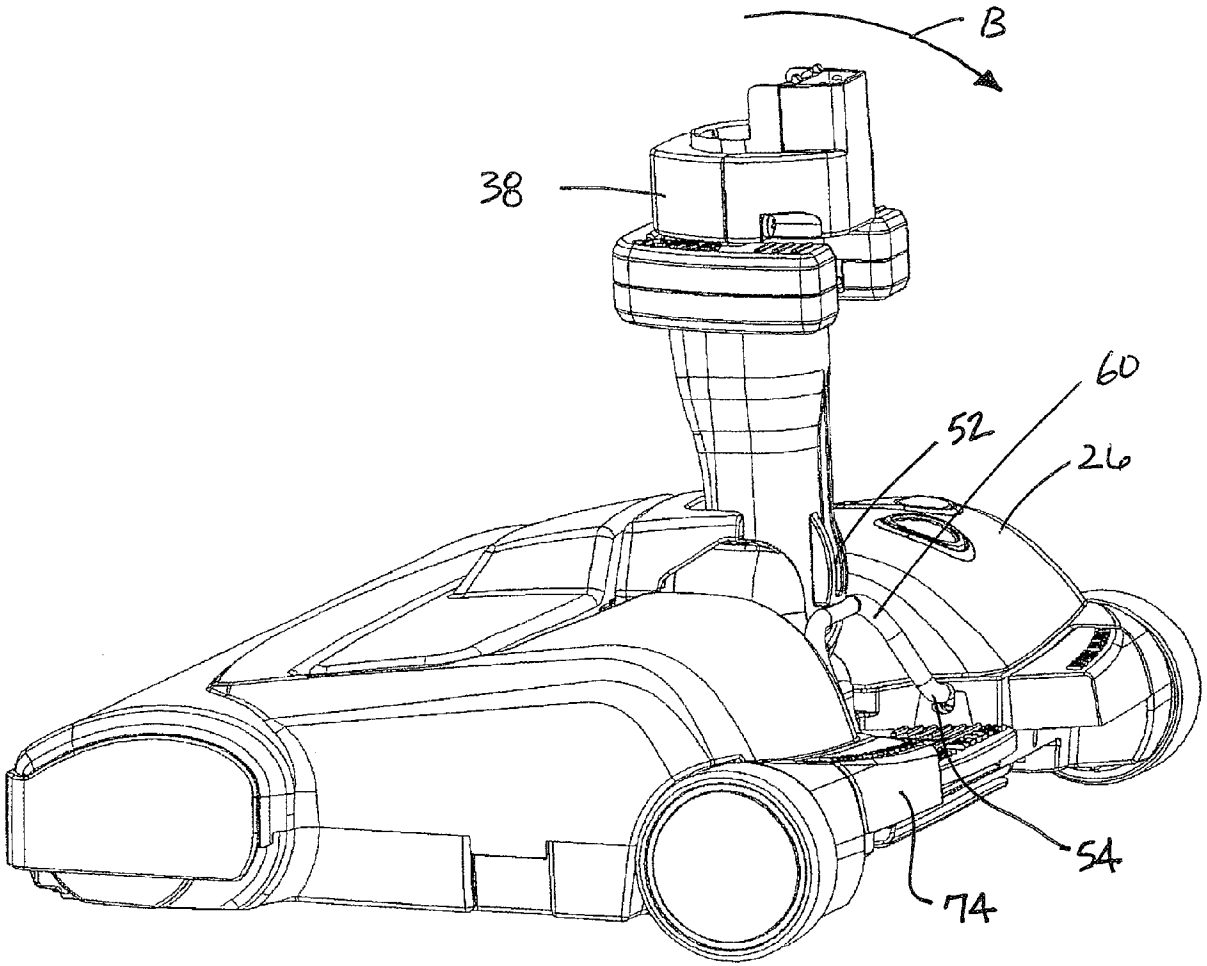
FIG. 5 is a detailed perspective view illustrating the control handle in the storage position and the latch assembly in the locking position.
Figure 6:
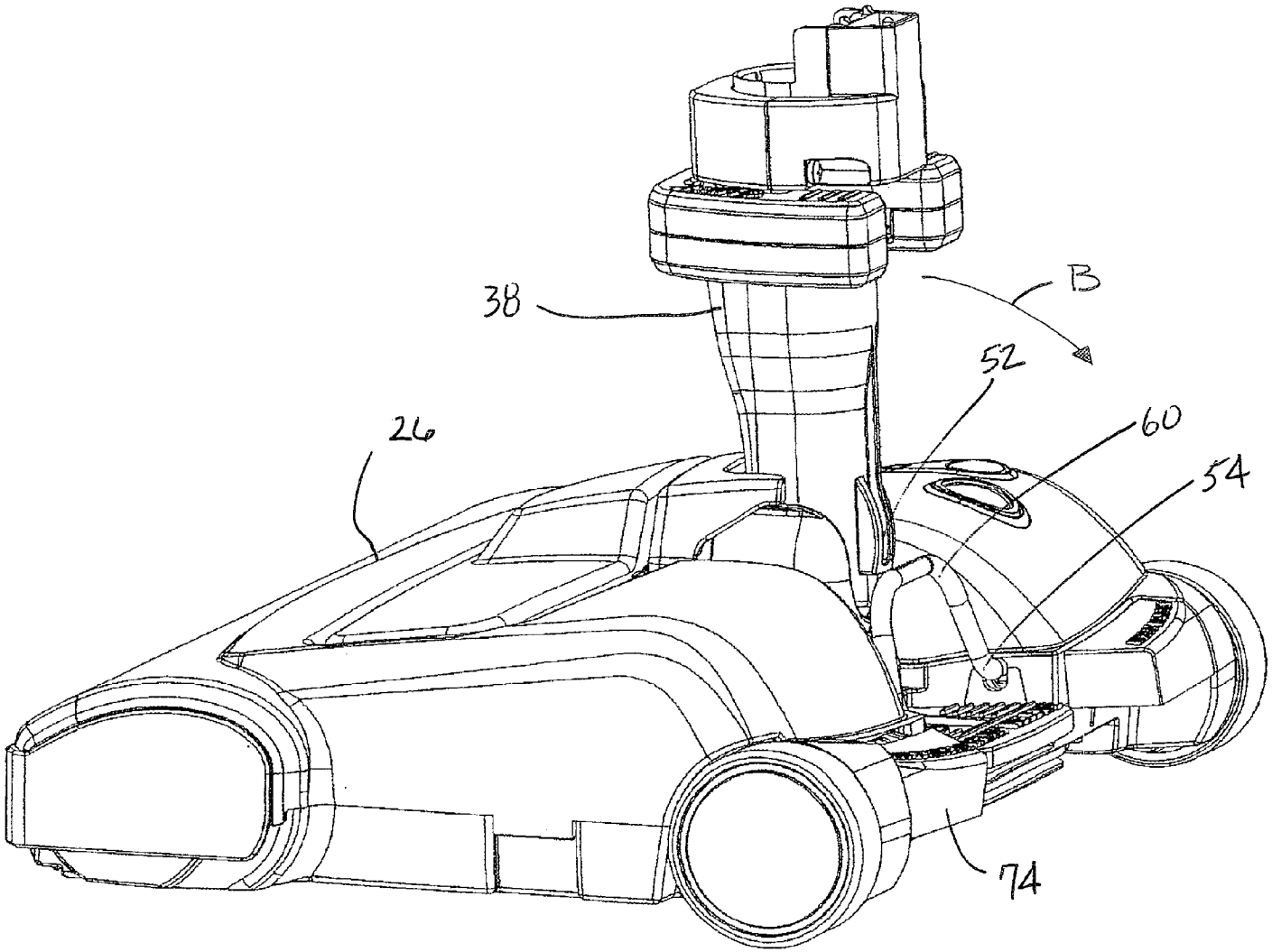
FIG. 6 is a perspective view similar to FIG. 5 but illustrating the latch in the release position and the depressed foot pedal actuator.

When the control handle 36 is in the upright storage position, the torsion spring 72 functions to bias the latch 54 into engagement with the latch stop 52 so as to secure and lock the control handle coupler 38 holding the control handle 36 (see particularly FIG. 5). When the operator wishes to release the control handle 36 from the storage position and move that handle into the operative position, the operator depresses the foot pedal actuator 74 (see FIG. 6). This causes the latch 54 to rotate about the rotational axis A (see FIG. 4) thereby drawing the n-shaped section 60 of the latch 54 out of contact with the latch stop (again see FIG. 6). The operator may then tilt the control handle 36 downwardly in the direction of action arrow B in FIG. 5 into the operating position (toward the viewer in FIG. 4). This allows the operator to easily manipulate the nozzle assembly 26 back and forth across the floor to allow cleaning where desired. When the operator is done, the operator pushes the control handle 36 back into the upright storage position illustrated in FIG. 1. The latch 54 smoothly glides over the outer surface of the latch stop 52 and then is biased by the torsion spring 72 into the locking position illustrated in FIG. 5 to again secure the control handle 36 in place.

Under certain situations an operator may inadvertently jerk the control handle 36 downward from the upright storage position. This can happen, for example, when removing the vacuum cleaner 10 from a closet by pulling on the handle section 40 while the nozzle assembly 26 is caught or covered by a heavy object. Over time such a "break-over" of the control handle without releasing the latch assembly 50 may cause damage to the latch assembly eventually leading to a failure thereof. The present invention avoids this by providing a mechanism for break-over release of the latch assembly 50.

Figure 4A:
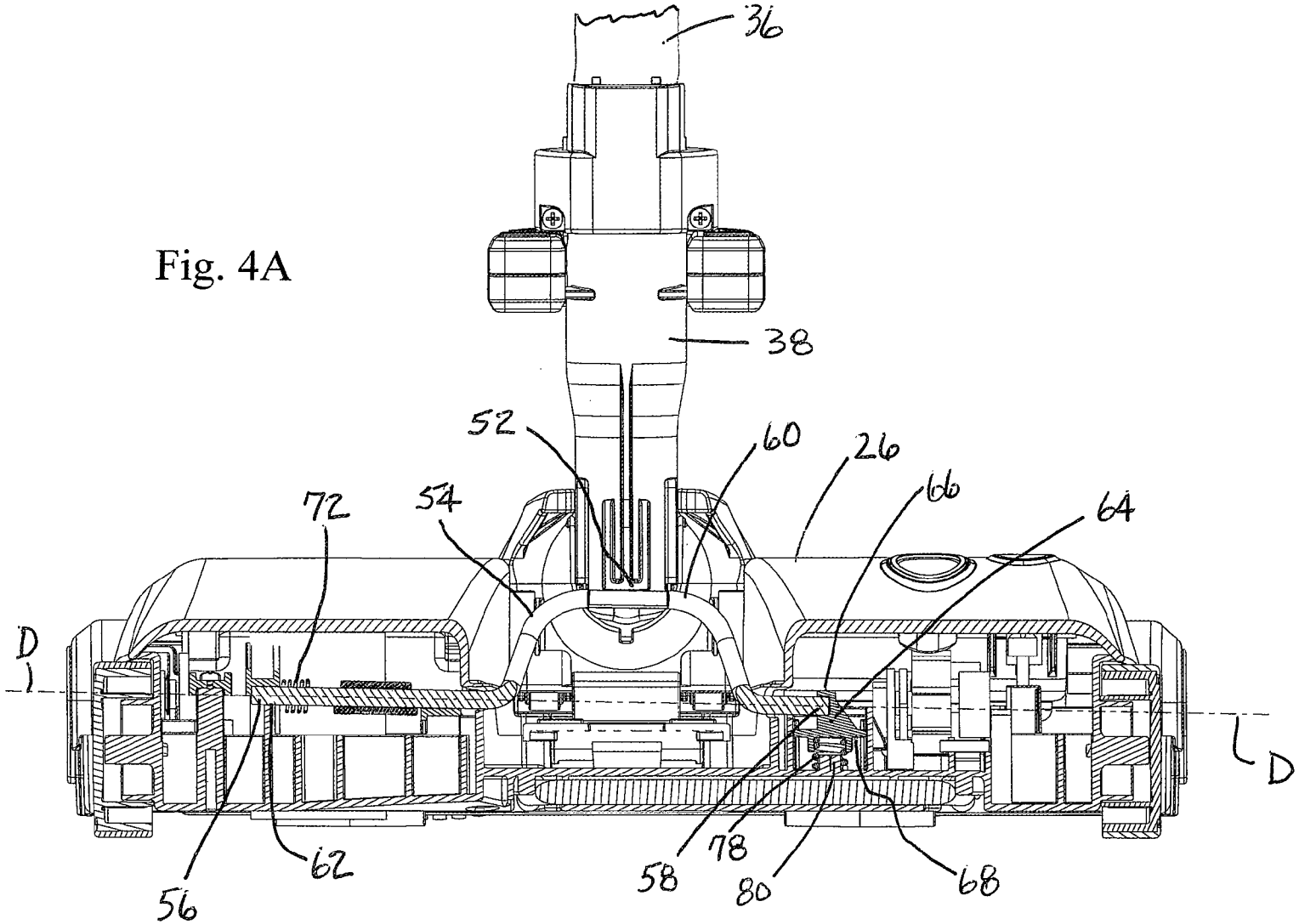
FIG. 4*a* is a detailed partly cross-sectional view illustrating the latch assembly on the nozzle assembly in the control handle break-over release position.
Figure 7:
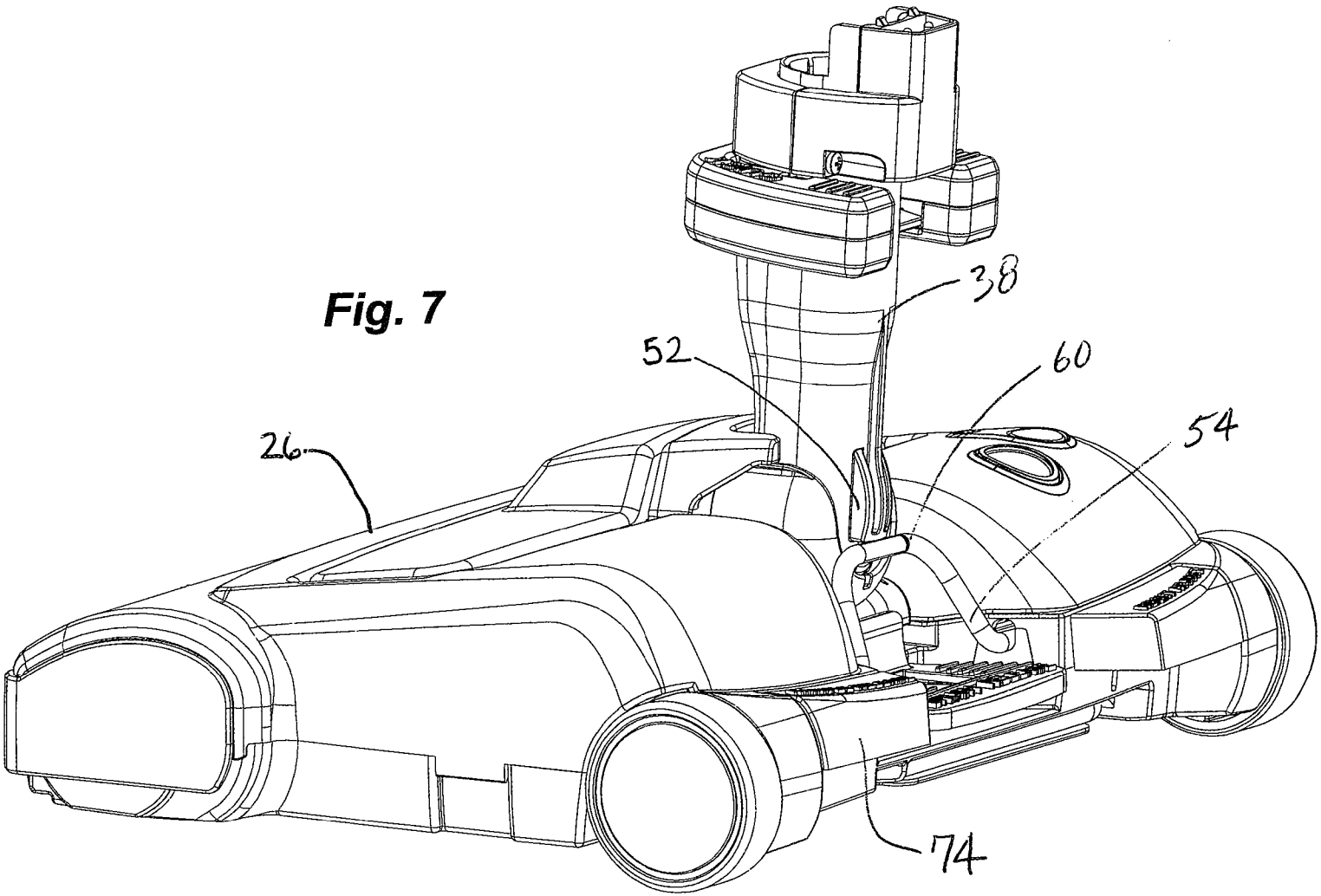
FIG. 7 is a detailed perspective view of the nozzle assembly illustrating the latch in the control handle break-over release position.

More specifically, any time the control handle 36 is moved from the storage position to the operating position without first releasing the latch assembly 50, the latch 54 is displaced from the locking position illustrated in FIG. 4 to the control handle break-over release position illustrated in FIGS. 4*a* and 7. As illustrated, the trunnion 64 is normally biased into the locking position by the second biasing element or compression spring 78. As illustrated, the compression spring 78 includes a first end received over a mounting lug 80 provided along the bottom wall of the channel 70. The second end of the compression spring 78 is received in a socket 82 provided along the bottom wall of the trunnion 64. The guide 68 allows free movement of the trunnion 64 in the channel 70 in the direction of action arrows C but prevents rotation.

When an operator pulls the control handle 36 downwardly from the storage position to the operating position without first releasing the latch assembly 50 by the foot pedal actuator 74, a downward force is produced on the latch 54 by the latch stop 52. This downward force overcomes the force of the compression spring 78 causing the trunnion 64 to move downwardly in the channel 70 from the position shown in FIG. 4 to the position shown in FIG. 4*a*. As illustrated in FIG. 7, this angular movement of the rotational axis of the latch 54 from the home position illustrated by line AA to the control handle break-over release position illustrated by line $\overline{DD}$ provides just enough movement to allow the latch stop 52 to clear the latch 54 without damaging the latch assembly 50 in any way. The aperture 62 holding the first end 56 of the latch 54 accommodates this limited pivotal movement. Thus, the latch assembly 50 is assured of providing a long service life.

Immediately after allowing the necessary clearance for the passage of the latch stop 52, downward pressure on the latch 54 is eliminated and the compression spring 78 again expands moving the latch 54 into engagement with the outer surface of the latch stop 52. As a consequence, when the operator again moves or shifts the control handle 36 to the storage position, the latch 54 is again biased by the first biasing element or torsion spring 72 into the locking position illustrated in FIG. 5.

The foregoing description of the preferred embodiment of the present invention have been presented for purposes of illustration and description. It is not intended to be exhaustive or to limit the invention to the precise form disclosed. Obvious modifications or variations are possible in light of the above teachings. For example, while the latch stop 52 is mounted on the control handle coupler 38 in the illustrated embodiment, it should be appreciated that it could be directly mounted on the control handle 36 if desired. The embodiments were chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled. The drawings and preferred embodiments do not and are not intended to limit the ordinary meaning of the claims in their fair and broad interpretation in any way.

What is claimed:

1. A floor care appliance, comprising:

a housing including a nozzle assembly having a suction inlet;

a dirt collection vessel carried on said housing;

a suction generator carried on said housing;

a control handle pivotally connected to said nozzle assembly and selectively displaceable between a storage position and an operating position; and a latch assembly displaceable between a locking position to secure said control handle in said storage position and a release position to allow full movement of said control handle into said operating position;

said latch assembly being characterized by:

a latch stop;

a latch carried on said nozzle assembly, said latch having a first end and a second end;

a first mounting point on said nozzle assembly receiving and holding said first end of said latch;

a second mounting point on said nozzle assembly receiving and holding said second end of said latch, said second mounting point being displaceable between a home position and a control handle break-over release position.

2. The floor care appliance of claim 1 further including a first biasing element to bias said latch into said locking position.

3. The floor care appliance of claim 2, further including a second biasing element to bias said second mounting point into said home position.

4. The floor care appliance of claim 3, wherein said first mounting point is an aperture in said nozzle assembly that receives and engages said first end of said latch while allowing free rotational movement and limited pivotal movement of said latch relative to said nozzle assembly.

5. The floor care appliance of claim 4, wherein said second mounting point is a trunnion and said trunnion is captured in a channel in said nozzle assembly.

6. The floor care appliance of claim 5, wherein said first biasing element is a torsion spring and said second biasing element is a compression spring.

7. The floor care appliance of claim 6, wherein said compression spring extends between a bottom wall of said channel and said trunnion.

8. The floor care appliance of claim 7, wherein said trunnion includes a slot receiving said second end of said latch and a guide received in a guide-way formed by said channel.

9. The floor care appliance of claim 8, wherein said latch includes an n-shaped section between said first end and said second end.

10. The floor care appliance of claim 8, further including a foot pedal connected to said latch.

11. The floor care appliance of claim 8, wherein said housing further includes a canister assembly.

12. The floor care appliance of claim 11, wherein said control handle comprises a wand and a flexible suction hose connects said wand to said canister assembly whereby a suction pathway is provided from said suction inlet on said nozzle assembly to said suction generator on said canister assembly through said wand, said flexible suction hose and said dirt collection vessel.

13. A floor care appliance, comprising;

a housing including a nozzle assembly having a suction inlet;

a dirt collection vessel carried on said housing;

a suction generator carried on said housing;

a control handle pivotally connected to said nozzle assembly and selectively displaceable between a storage position and an operating position; and a latch assembly displaceable between a locking position to secure said control handle in said storage position and a release position to allow full movement of said control handle into said operating position;

said latch assembly being characterized by:

a latch stop;

a latch carried on said nozzle assembly wherein said latch includes an axis of rotation and said axis of rotation is displaceable between a first, home position and a second, control handle break-over release position.

14. The floor care appliance of claim 13, further including (a) a first mounting point on said nozzle assembly receiving and holding a first end of said latch and (b) a second mounting point on said nozzle assembly receiving and holding a second end of said latch, said second mounting point being displaceable between a home position and a control handle break-over release position.

15. The floor care apparatus of claim 14, further including a first biasing element to bias said latch into said locking position.

16. The floor care appliance of claim 15, further including a second biasing element to bias said second mounting point into said home position.

17. The floor care appliance of claim 16, wherein said first mounting point is an aperture in said nozzle assembly that receives and engages said first end of said latch while allowing free rotational movement and limited pivotal movement of said latch relative to said nozzle assembly.

18. The floor care appliance of claim 17, wherein said second mounting point is a trunnion and said trunnion is captured in a channel in said nozzle assembly.

19. The floor care appliance of claim 18, wherein said first biasing element is a torsion spring and said second biasing element is a compression spring.

20. The floor care appliance of claim 19, wherein said compression spring extends between a bottom wall of said channel and said trunnion.

21. The floor care appliance of claim 20, wherein said trunnion includes a slot receiving said second end of said latch and a guide received in a guide-way formed by said channel.

22. The floor care appliance of claim 21, wherein said latch includes an n-shaped section between said first end and said second end.

23. The floor care appliance of claim 22, further including a foot pedal connected to said latch.

24. The floor care appliance of claim 23, wherein said housing further includes a canister assembly.

25. The floor care appliance of claim 24, wherein said control handle comprises a wand and a flexible suction hose connects said wand to said canister assembly whereby a suction pathway is provided from said suction inlet on said nozzle assembly to said suction generator on said canister assembly through said wand, said flexible suction hose and said dirt collection vessel.

* * * * *